United States Patent [19]

Tsuji et al.

[11] Patent Number: 4,526,273

[45] Date of Patent: Jul. 2, 1985

[54] PORTABLE COSMETICS CASE

[75] Inventors: Hiroshi Tsuji, Kanagawa; Hirofumi Katada, Tokyo, both of Japan

[73] Assignee: POLA Chemical Industries, Inc., Shizuoka, Japan

[21] Appl. No.: 555,003

[22] Filed: Nov. 21, 1983

[30] Foreign Application Priority Data

Nov. 24, 1982 [JP] Japan ..... 57-177539[U]

[51] Int. Cl.[3] ..... A45D 33/28; A45D 40/24; B65D 61/00

[52] U.S. Cl. ..... 206/229; 206/581; 206/235; 206/385; 206/39.6; 206/815; 206/823; 132/79 G; 132/82 D; 132/83 C

[58] Field of Search ..... 206/229, 235, 385, 446, 206/39.6, 823, 815; 132/79 G, 82 C, 82 D, 83 C, 83 E; 312/119, 330 R

[56] References Cited

U.S. PATENT DOCUMENTS

| | | | |
|---|---|---|---|
| 1,848,178 | 3/1932 | Kasdan | 132/79 G |
| 1,851,462 | 3/1932 | Steller | 132/82 D |
| 2,013,281 | 9/1935 | McCalla | 206/456 |
| 2,196,127 | 4/1940 | Stogran | 206/385 |
| 2,424,432 | 7/1947 | Bower | 132/79 G |
| 2,456,948 | 12/1948 | Kaye | 132/79 G |
| 2,497,950 | 2/1950 | Lohr et al. | 206/385 |
| 2,534,100 | 12/1950 | Baumgartner | 206/229 |
| 2,553,348 | 5/1951 | Zurndorfer | 132/79 G |
| 3,115,270 | 12/1963 | Melnikoff | 220/306 |

FOREIGN PATENT DOCUMENTS

| | | | |
|---|---|---|---|
| 1147319 | 6/1959 | France | 206/235 |
| 2470555 | 6/1981 | France | 206/823 |
| 57-32805 | 7/1982 | Japan . | |
| 58-18807 | 4/1983 | Japan . | |
| 462220 | 3/1937 | United Kingdom | 206/235 |
| 1059893 | 2/1967 | United Kingdom | 206/385 |

*Primary Examiner*—William Price
*Assistant Examiner*—Brenda J. Ehrhardt
*Attorney, Agent, or Firm*—Wenderoth, Lind & Ponack

[57] ABSTRACT

A portable cosmetics case includes a hollow and flat box-like case body. The case body has an opening at one end which opens downwardly. A plurality of cosmetic containers containing e.g. lipsticks, a compacted powder case, and a painting brush are inserted in the case body. Each cosmetic container has an end portion closing the opening in the case body. Thus, the cosmetics case has a smooth box-like external appearance. The cosmetic containers received in the case body can be replaced as desired according to the user's preference.

5 Claims, 20 Drawing Figures

PORTABLE COSMETICS CASE

BACKGROUND OF THE INVENTION

1. Field of the Invention

The present invention relates to a cosmetics case, and more particularly to a cosmetics case which is portable and convenient to use.

2. Description of the Prior Art

Various cosmetics cases have been used to satisfy demands that they should be compact and convenient for use, have an attractive appearance, and be such as to allow the cosmetics contained therein to be easily handled.

SUMMARY OF THE INVENTION

The object of the present invention is to satisfy the above-mentioned demands and to provide a cosmetics case which can contain, according to the user's preference, cosmetics or alternatively dress making materials, by replacing cosmetic containers received in the case.

To satisfy the above-mentioned object, the portable cosmetics case, according to the present invention, comprises a flat box-like hollow case body defining therein an accommodation space and having an opening at one end, a mirror attached on the top plate of the body, and at least one cosmetic container removably received through the opening in the accommodation space. The cosmetic container being selected from the following forms: a cosmetic container at one end of which is mounted a lipstick or painting pencil; a cosmetic container of the upwardly opening box type containing one or more compact-type cosmetics; and a cosmetic container on which is mounted a painting stick having a brush or sponge at its free end.

The objects and features of the present invention will be better understood by the following detailed description made by way of examples, with reference to the accompanying drawings.

DETAILED DESCRIPTION OF THE PREFERRED EMBODIMENTS

Figure 1:
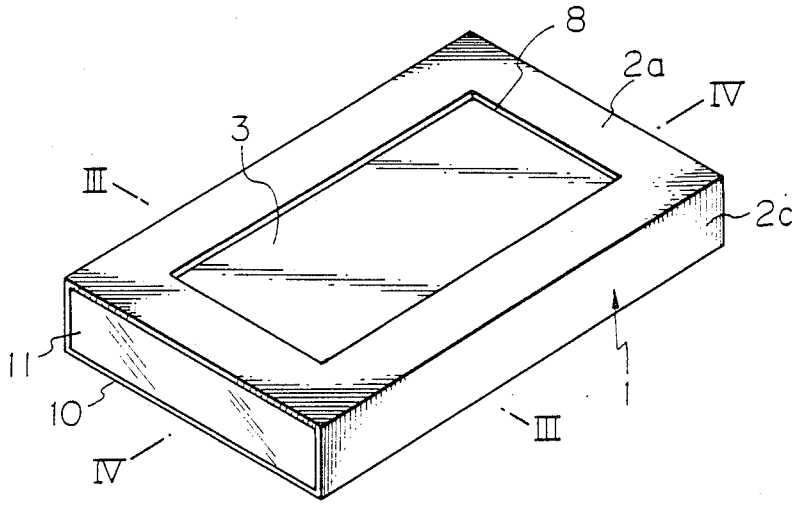
FIG. 1 is a perspective view of a cosmetics case, according to the first embodiment of the present invention.
Figure 2:
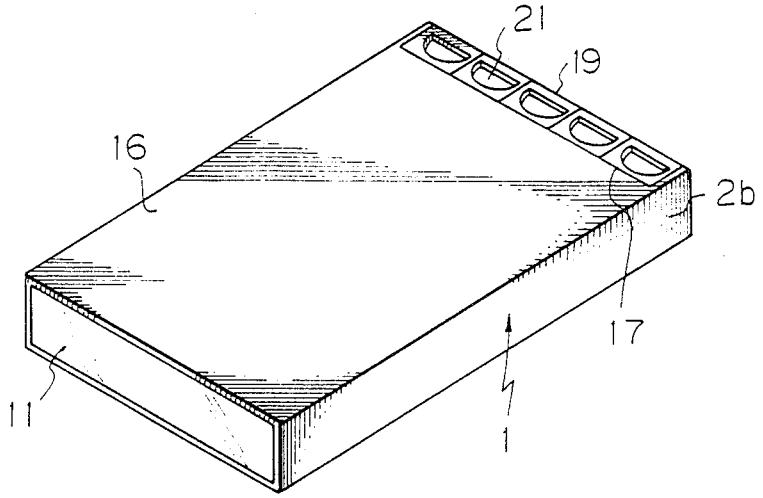
FIG. 2 is a perspective bottom view of the cosmetics case shown in FIG. 1.
Figure 3:
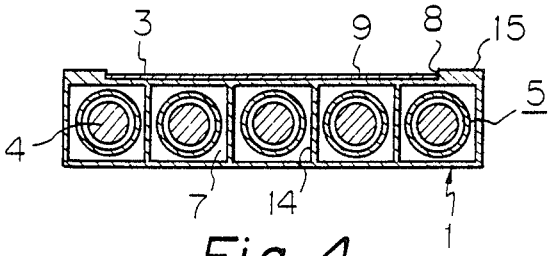
FIG. 3 is a sectional view along line III—III of FIG. 1.
Figure 4:
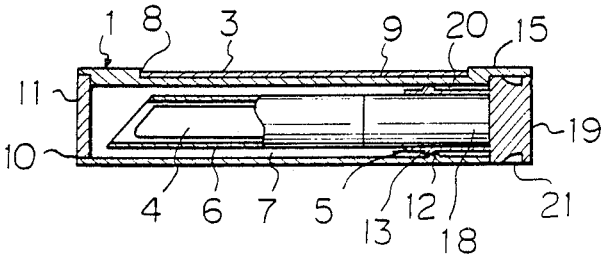
FIG. 4 is a sectional view along line IV—IV of FIG. 1.

FIGS. 1–6 show a cosmetics case according to the first embodiment of the present invention having a body 1 which forms a generally flat box which has an opening 2 (FIG. 5) at one end. This opening 2 opens sideway (rightward in FIG. 1) and downwardly. The body 1 is preferably formed of synthetic resin and is hollow to form an accommodation space 7 (FIGS. 3 and 4. In the embodiment shown, the accommodation space 7 is divided into five spaces by partition walls 14 (FIG. 3 only). To the top wall of the body 1, a mirror 3 (FIGS. 1 and 3–5) is adhered. The mirror 3 is adhered in a recess 8 of the top wall by adhesive 9 (FIGS. 3 and 4). A transparent plate 11 (FIGS. 1, 2 and 4) is secured to the body 1 at one end 10 opposite to the opening 2, in order to allow a view into the accommodation space 7. In the space 7 adjacent to the opening 2, a transversly extending retaining projection 12 (FIGS. 4 and 5) is formed.

Figure 5:
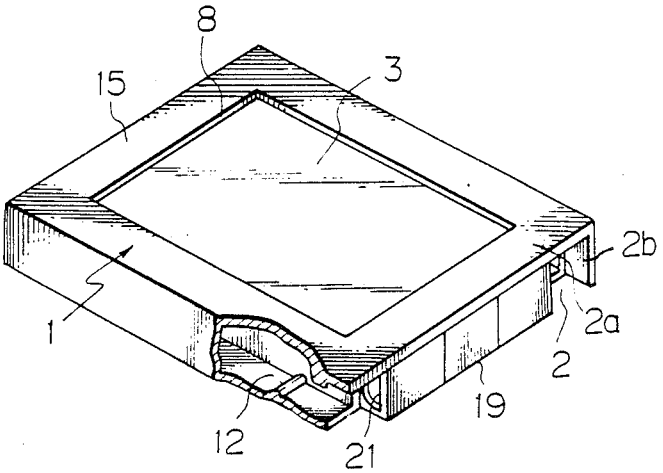
FIG. 5 is a perspective view similar to FIG. 1 in which a portion is broken away to show the interior of the case construction.
Figure 6:
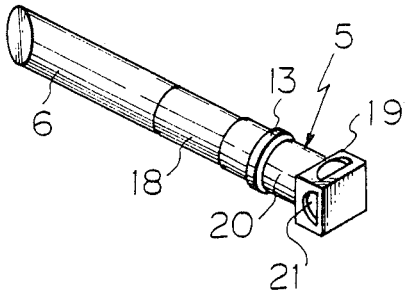
FIG. 6 is a perspective view of a cosmetic container, according to the present invention, to be received in the case shown in FIG. 1.

In each of the divided small compartments of the space 7, a cosmetic container 5 (FIGS. 3, 4 and 6) is received releasably. In the embodiment shown, the cosmetic container 5 contains telescopically a lipstick 4 (FIGS. 3 and 4). Outer end portion 19 (FIGS. 4–6) of the container 5 is generally square shaped and each side of the outer end portion 19 has a claw recess 21 (FIGS. 4–6). When the container 5 is engaged in the compartment of the space 7, the outer end portion 19 makes contact with a lower edge 17 (FIG. 2 only) of the opening 2 of the case 1 and thus the lower surface is aligned with the bottom surface of the case 1. The other side surfaces of the outer end portion 19 are covered by portions 2*a*, 2*b* and 2*c* (FIGS. 1, 2 and 5) of the case 1 which are defined to form the opening 2 of the case 1. Thus, the space 7 is kept free from dust, and the completed case has an aesthetically pleasing appearance. The container 5 has a body formed by a cylindrical portion 20 (FIGS. 4 and 6) adjacent to the end portion 19. The cylindrical portion 20 has a peripheral projection 13 (FIGS. 4 and 6) which engages with the retaining projection 12 in the space 7 when the container 5 is received in the case 1. The cylindrical portion 20 has a cylindrical body 18 (FIGS. 4 and 6) which holds the lipstick 4 and a cover 6. The telescopic mechanism is operated by relative rotation between the cylindrical body 18 and the cover 6.

In operation, a desired container 5 is pulled out from a small compartment of the space 7, and the lipstick 4 projects from the cover 6. Painting of the lips can be easily performed with the aid of the mirror 3 attached to the case 1. The cosmetics case 1 is compact and easily carried.

Figure 7:
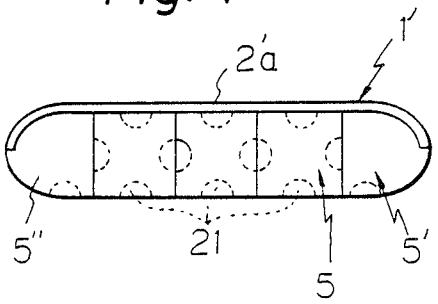
FIG. 7 is an end view of a cosmetics case according to the second embodiment of the present invention.
Figure 8:
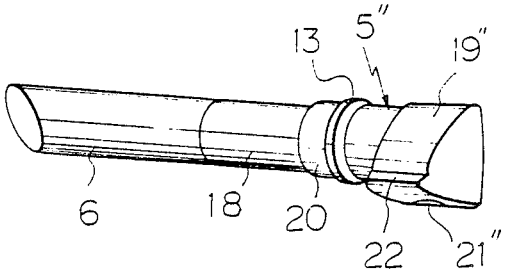
FIG. 8 is a perspective view of a cosmetic container to be received in the case shown in FIG. 7.

FIGS. 7 and 8 show a cosmetic case, according to the second embodiment of the present invention. The case includes a case body 1' which is rounded at both sides. Half of the end opening of the body 1' is covered by a cover portion 2'a. Cosmetic containers 5' and 5'' which are to be received in both side small compartments of the space 7 each include end portion 19'' and a step 22 as shown in FIG. 8, which shows only the container 5''. Also, each of the containers 5' and 5'' has only one claw recess 21' or 21''. The remaining construction of the case as shown in FIGS. 7 and 8 is similar to the case shown in FIGS. 1-6.

Figure 13:
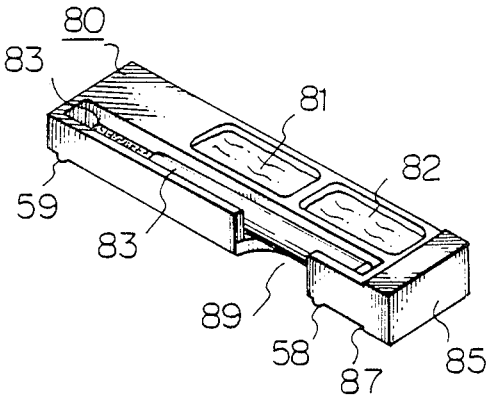
FIG. 13 is a perspective view of a fourth cosmetic container to be received in the case shown in FIG. 9.
Figure 14:
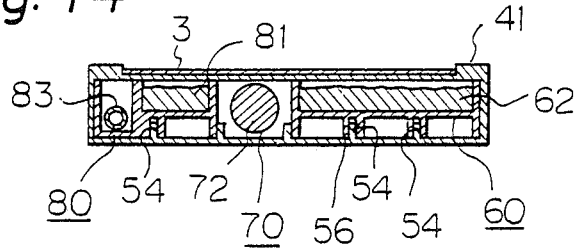
FIG. 14 is a sectional view along line XIV—XIV of FIG. 9.
Figure 15:
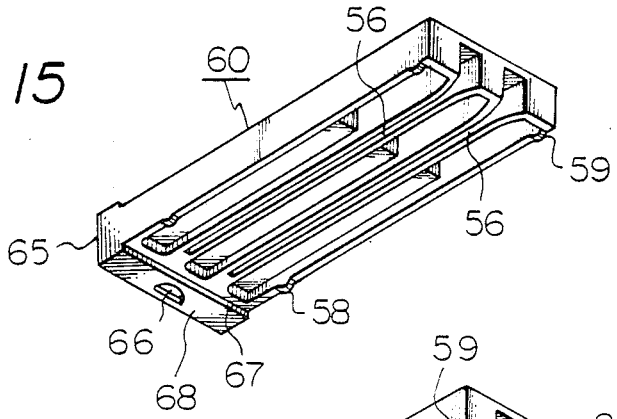
FIG. 15 is a perspective bottom view of the second cosmetic container shown in FIG. 9.

FIGS. 9-16 show a cosmetics case, according to third embodiment of the present invention. The cosmetics case includes a flat box-shaped case body 41 (FIGS. 9-11 and 14) which has an opening 42 (FIGS. 9 and 10) at one side and an accommodation space 47 (FIG. 10 only) in the body 41. On the top plate of the case body 41, a mirror 43 (FIGS. 9 and 10) is attached. In the accommodation space 47 a plurality of cosmetic containers are received through the opening 42 thereof. In the illustrated embodiment there is shown a second cosmetic container 60 (FIGS. 9-10 and 14-15) shaped generally like a box with its top opened and receiving cosmetics such as compacted face powders 61, 62 and 63 (FIGS. 9 and 10); a third cosmetic container 70 (FIGS. 9, 11-12 and 14) having a painting stick 72 (FIGS. 12 and 14) which has a painting brush or sponge 71 (FIG. 12 only) at one end; a fourth cosmetic container 80 (FIGS. 9, 11, 13-14 and 16) receiving cosmetics such as eyebrow or shade aid 81 (FIGS. 13 and 14) and 82 (FIG. 13 only) which are different from the cosmetics 61 - 63, and an eyebrow brush 83 (FIGS. 13 and 14).

Figure 10:
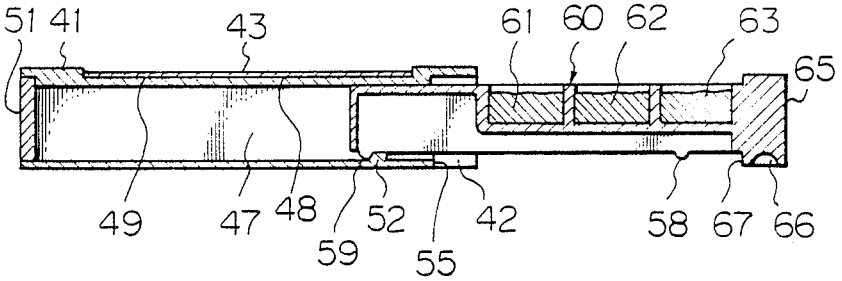
FIG. 10 is a sectional view along line X—X of FIG. 9.

The case body 41 is preferably formed from a synthetic resin material similar to the first embodiment and includes a recess 48 (FIG. 10 only) on the top surface to attach the mirror 43 formed of suitable material e.g. glass, metal plate or synthetic resin, by suitable adhesive 49 (FIG. 10 only). The rear end wall opposite to the opening 42 may be formed of transparent material to enable viewing into the space 47.

In the accommodation space 47, longitudinal parallel projections 54 (FIG. 14) are formed integrally with the bottom wall to reinforce the case body 41 and to act as guide rails for the cosmetic containers 60, 70 and 80. Further, on the bottom wall in the accommodation space 47 near the opening 42, a small retaining projection 52 (FIG. 10) is formed perpendicular to the projections 54. To engage with the projections 54, on the bottom wall of the containers 60 and 80, longitudinal recesses 56 (FIGS. 14-16) are formed corresponding to the projections 54. Also on each bottom wall of the containers 60 and 80, there is a small transverse projection 59 (FIGS. 10, 13, and 15-16) which controls the pull out position of the container 60 or 80 by engaging with the retaining projection 52 and a small transverse projection 58 (FIGS. 9-10, 13 and 15,16) which retains the container 60 or 80 in a closed or fully retracted position by engaging with the retaining projection 52 in the space 47. In place of the small projection 58, the vertical dimension of the cosmetic container may be made somewhat less at its outer end portion. Or, in place of the projection 52, the thickness of the bottom wall 54' of the case body 41 may be made somewhat thicker adjacent to the opening 42 relative to other portions, so as to retain the containers by means of the step portion formed by the change of thickness.

As before, the bottom wall 54' (FIG. 11) of the case body 41 is recessed to define edge 55 (FIGS. 10 and 11) which acts as the lower edge of the opening 42. The outer end portion 65 (FIGS. 9-11 and 15) of the second container 60 is generally rectangular and includes inward step surface 67 (FIGS. 10 and 15) to engage with the edge 55 of the case body 41. When the step surface 67 engages with the edge 55, the top and side surfaces of the outer end portion 65 are covered by the cover portions of the case body 41 to give a smooth box shape to the cosmetics case. On the lower surface 68 (FIGS. 11 and 15) of the outer end portion 65, a claw recess 66 (FIGS. 10-11 and 15) is formed. Similar step surfaces 77 and 76 (FIG. 12 only) and claw recesses 87 (FIGS. 13 and 16) and 86 (FIGS. 11 and 16) are formed on the outer end portions 75 (FIGS. 9 and 11-12) and 85 (FIGS. 9, 11, 13 and 16) of the third and fourth containers 70 and 80.

Figure 16:
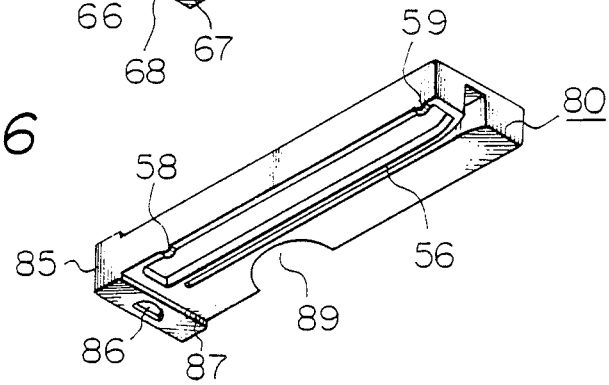
FIG. 16 is a perspective bottom view of the fourth cosmetic container shown in FIG. 13.

As shown in FIGS. 13 and 16, a recess 89 is formed on one side surface of the container 80 in which the brush 83 can be easily placed or taken out.

The third cosmetic container 70 includes a peripheral projection 73 (FIG. 12 only) to engage with the projection 52 in the space 47. The outer end portion 75 of the container 70 is square so that claw recesses 66 are formed on all side surfaces of the outer end portion 75 of the container 70.

Figure 9:
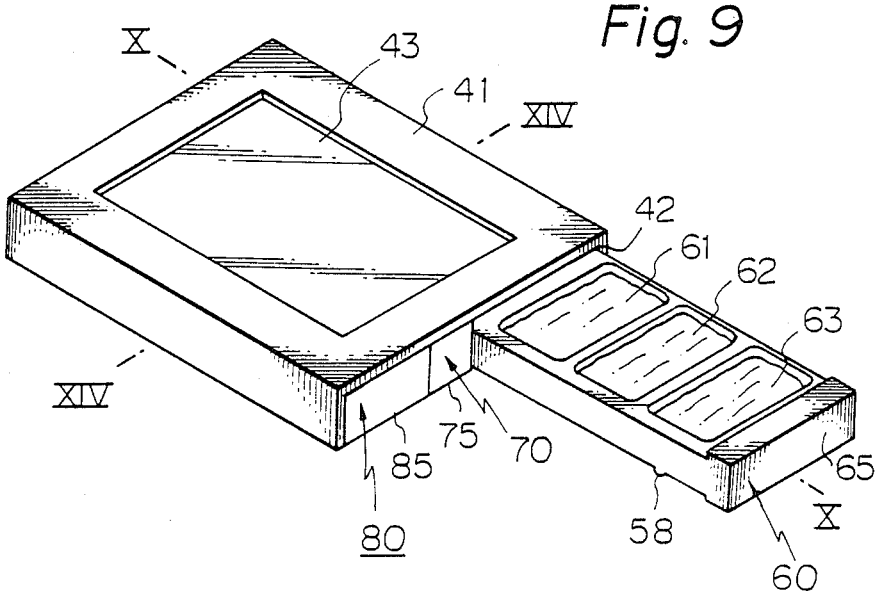
FIG. 9 is a perspective view of a cosmetic case, according to the third embodiment of the present invention, in which a cosmetic container, which is referred as a second cosmetic container, is pulled out from its recess.
Figure 11:
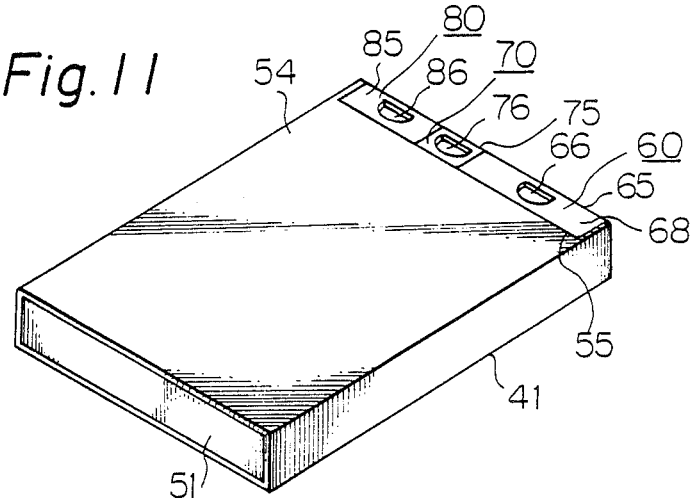
FIG. 11 is a bottom view of the cosmetics case shown in FIG. 9 with the cosmetic container being fully received in the case.
Figure 12:
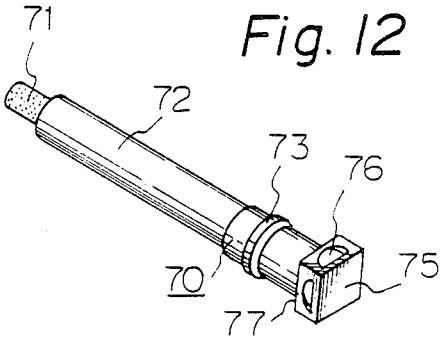
FIG. 12 is a perspective view of a third cosmetic container to be received in the case shown in FIG. 9.
Figure 17:
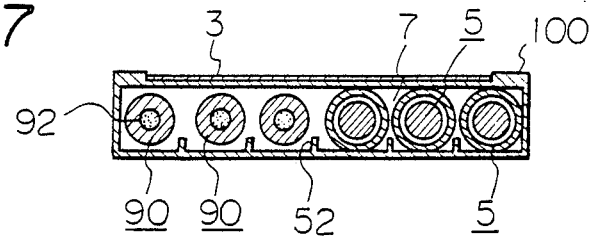
FIG. 17 is a sectional view similar to FIG. 14 but the case illustrated receives different cosmetic containers.
Figure 18:
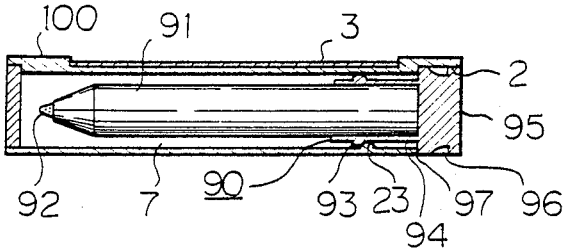
FIG. 18 is a longitudinal sectional view of FIG. 17.
Figure 19:
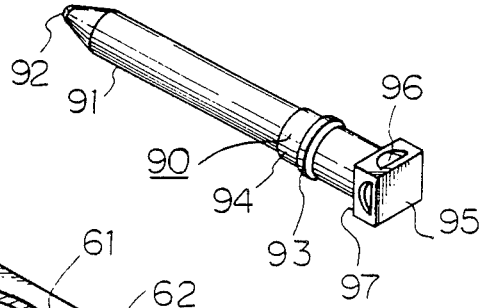
FIG. 19 is a perspective view of a fifth cosmetic container, according to the present invention, received in the case shown in FIG. 17.

In the embodiment shown in FIGS. 17-19, the cosmetics case shown in FIGS. 9-11 receives three lipstick containers 5 similar to that shown in FIG. 6 and three pencil containers 90 in place of the containers 60, 70 and 80.

The pencil container or fifth cosmetic container 90 holds a pencil shaped cosmetic 92 covered by a barrel 91 of, for example, wood or paper. The container 90 includes a square shaped outer end portion 95 which has claw recesses 96 on all side surfaces and an inward faced step portion 97. The container 90 has a peripheral recess to engage with the retaining projection 52 in the space 47 of the case body 41.

Figure 20:
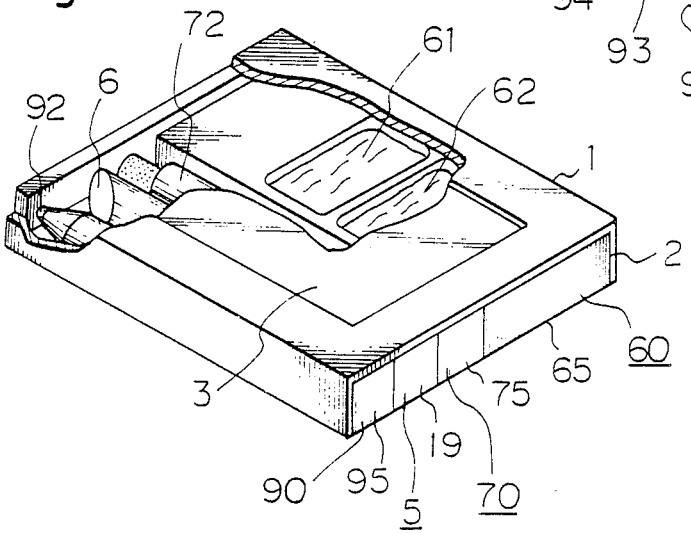
FIG. 20 is a partially broken away perspective view of the cosmetics case shown in FIG. 9 but in this case containing another combination of cosmetic containers.

FIG. 20 shows the case body 41 of the cosmetics case shown in FIGS. 9-11 receiving in this case cosmetic containers 60, 70, 5 and 90.

It will be appreciated that the cosmetics case according to the present invention can receive suitable cosmetic containers selected from various cosmetic containers available, as desired by the user, and also is very convenient for transportation and use.

What is claimed is:

1. A portable cosmetics case comprising:

a flat box-like hollow case body defining therein an accommodation space and having a rectangular cross-section with the width being an integer multiple of a unit width and the height being a predetermined height, said accommodation space having an opening at one end and having a width of at least five unit widths;

a plurality of cosmetic containers removably received respectively through the opening into the accommodation space;

said plurality of cosmetic containers filling up the accomodation space and being selected from among the following items:

(a) a first cosmetic container on which is mounted one of a lip stick, a painting pencil, a painting stick, and the like at one end and having a width equal to one unit width, (b) a second cosmetic container of upwardly opening boxlike shape containing one or more cosmetics, a cosmetic brush, and the like, and having a width of two unit widths, and (c) a third cosmetic container of upwardly opening box-like shape containing one or more cosmetics and having a width being equal to three unit widths.

2. A portable cosmetic case according to claim 1 wherein said predetermined height is equal to the unit width.

3. A portable cosmetic case according to claim 1, further comprising:

a mirror provided on the case body.

4. A portable cosmetic case according to claim 1, further comprising:

a plurality of ridge means, formed on an inner wall of the case body in order to project into the accommodation space, for guiding the cosmetic containers therein.

5. A portable cosmetic case according to claim 1, further comprising:

a transparent wall positioned on the case body at the other end opposing said opening of the accommodation space.

* * * * *